United States Patent [19]

Ruer et al.

[11] 4,164,974

[45] Aug. 21, 1979

[54] LIQUID-COOLED ELECTROMAGNETIC CONTINUOUS CASTING MOLD

[76] Inventors: Jacques Ruer, 87 bis rue Georges Ducrocq; Louis Vedda, 31 avenue de Strasbourg, both of Metz, France, 57000

[21] Appl. No.: 852,208

[22] Filed: Nov. 17, 1977

[30] Foreign Application Priority Data

Nov. 17, 1976 [FR] France ..... 76 34681

[51] Int. Cl.[2] ..... B22D 27/02; B22D 11/124

[52] U.S. Cl. ..... 164/147; 164/250; 164/443; 164/348

[58] Field of Search ..... 164/48, 49, 146, 147, 164/148, 154, 251, 414, 348, 250, 443

[56] References Cited

U.S. PATENT DOCUMENTS

| | | | |
|---|---|---|---|
| 3,630,270 | 12/1971 | Adamec | 164/348 |
| 3,941,183 | 3/1976 | Vedda et al. | 164/251 |

*Primary Examiner*—Othell M. Simpson
*Assistant Examiner*—K. Y. Lin
*Attorney, Agent, or Firm*—Kurt Kelman

[57] ABSTRACT

A jacketted mold for the continuous casting of molten metal is surrounded by an enclosed cooling space holding an electromagnetic inductor for moving the molten metal in the open-ended mold. A cooling liquid is supplied to the cooling space through an inlet chamber and is removed therefrom through an outlet chamber after it has passed through a primary circuit along the tubular mold element. The outlet chamber is divided into two liquid flow circuits, one circulating the liquid from the primary circuit across the inductor at a reduced flow velocity, and the second one being arranged in parallel with the first one for directly, removing the liquid from the primary circuit to the discharge conduit immediately after it has circulated along the tubular mold element.

2 Claims, 2 Drawing Figures

LIQUID-COOLED ELECTROMAGNETIC CONTINUOUS CASTING MOLD

The present invention relates to ingot molds for the continuous casting of molten metallic products, particularly flat products of large section, comprising means for causing a cooling liquid to circulate and means for imparting movement to the cast metal within the mold by electromagnetic action.

The control of convection movements in a molten metal within the continuous casting mold, developed particularly by means of an electromagnetic inductor, produces a number of metallurgical advantages, as has been known, particularly in connection with the inclusionary cleanliness under the skin of the solidified metal.

If such techniques already form part of the industrial practice in the case of products of small size, such as billets (U.S. Pat. Nos. 3,941,183, dated Mar. 2, 1976, and 4,026,346, dated May 31, 1977), this is not the case with respect to products of larger dimensions, such as blooms. In this case, as a matter of fact, the electric power required to obtain adequate stirring implies the use of inductors of large size which, in addition, must be suitably cooled without, however, disturbing the primary cooling of the cast products themselves. Since water is the liquid most often used for cooling ingot molds, the subsequent text will frequently refer to this element but it is well understood that the present invention is also applicable to other liquids.

In what follows, "primary cooling" is understood to refer to the heat exchange necessary between the cast products and the cooling liquid across the interior tubular element of the mold defining a passage for the former. The term "primary water" will, therefore, designate the water which has first served for the extraction of calories by heat exchange with molten products by circulation along the interior tubular element in contact with the cast metal.

In U.S. patent application Ser. No. 723,194, filed in the name of the present applicant, there has been described an ingot mold for blooms of this type whose electromagnetic inductor producing a traveling wave magnetic field, immersed in an upper discharge chamber, is cooled by the primary water of the mold. In the described embodiment, the primary water introduced into the upper chamber above the inductor integrally bathes the same before it flows at the lower part of the chamber through a discharge conduit provided in the casing of the latter. In this manner, all the primary water serves for the cooling of the inductor, which may in some cases be superabundant with respect to the actual cooling needs of the coils. Furthermore, because of the considerable space occupied by the inductor, the latter introduces substantial pressure losses in the cooling circuit, which is sometimes difficult to compensate by a possible increase in the pressure in the water supply installation. This results in a general reduction in the cooling water flow, which may have very prejudicial effects, less for the thermal maintenance of the inductor than for the good operation of the ingot mold itself. On the other hand, these dispositions imply that the water flow across the inductor is, on the average, not vertical but presents an orientation in the direction of the port of the discharge conduit. This results in differences in the pressure losses between the cooling water currents, depending on whether they are introduced into the upper chamber at places close to or far from the port of the discharge conduit. These differences in the pressure losses may lead, particularly in the case of ingot molds comprising vertical channel for the cooling water, to burns in the interior tubular element, resulting in phenomena of "flow redistribution" in the different "channels", which manifest themselves in a partial distribution of the primary water flow in the channels under less pressure, to the detriment of the more highly pressurized channels, leading for a short time to the shutdown of the mold.

The present invention has exactly the object of proposing a new cooling circuit in order to remedy the above-cited inconveniences.

To this end, the present invention has as object a continuous casting apparatus wherein the cast metallic products are simultaneously put into movement, comprising an ingot mold energetically cooled along its interior tubular element by a cooling liquid circulating between a lower inlet chamber and an upper outlet chamber, and an electromagnetic inductor immersed in the outlet chamber, this apparatus being characterized in that the outlet chamber includes means for dividing the discharge circuit of the primary cooling liquid into two distinct and parallel circuits: a "retarded" discharge circuit traversing the said inductor in a manner assuring its cooling and a "direct" discharge circuit mounted in parallel to the former, and assuring the discharge of the cooling liquid immediately after it has passed along the interior tubular element of the ingot mold.

According to a complementary characteristic, the outlet chamber also has means for changing at will the divison of the primary cooling liquid into the two above-mentioned distinct circuits.

According to a particular embodiment of the invention, the means for dividing the primary cooling liquid into two distinct and parallel circuits is constituted by an interior partition wall disposed at the periphery of the inductor and longitudinally dividing the outlet chamber into two lateral compartments, respectively an interior one, in which the inductor is disposed and into which the primary cooling liquid is introduced after its passage along the interior tubular element of the mold, and an exterior one, in direct communication with a discharge conduit, these two compartments being interconnected by openings at the lower and upper ends of the said partition wall.

According to one particular feature, the means for changing the division of the primary cooling liquid into two distinct and parallel discharge circuits is constituted by variable shut-off elements of the exterior lateral compartment, disposed at a point between the discharge conduit and the openings at the end of the partition wall adjacent the place where the primary cooling liquid is introduced into the outlet chamber.

As will be understood, the invention consists in its essential characteristics in the modification of the discharge circuit of the primary cooling liquid of the mold by creating, at the level of the outlet chamber occupied by the inductor, two distinct circuits mounted in parallel: on a conventional discharge circuit completely traversing the inductor to assure the cooling thereof, a circuit which may be qualified as "retarded" or "difficult" because of the pressure losses it generates during the flow, applicant superimposes a "direct" or "easy" circuit, with small pressure losses and mounted as a branch of the former. This additional circuit has no cooling function but may be considered simply as a bleeding circuit serving, by its presence, to equalize the pressure losses in the primary cooling liquid of the mold along the interior tubular element and thus to make all the cooling channels hydraulically equivalent to each other.

Likewise and by analogy to what is presently known in the field of electricity, the above-mentioned additional circuit may be considered as mounted in "shunt" with the initial circuit between the point where the primary cooling water enters into the outlet chamber and the point where it is discharged. This is possible because the quantity of water necessary for cooling the inductor, even at maximal operation, represents only a small fraction, of the order of 10%, of the quantity of water required for the primary cooling of the cast products in the ingot mold.

In its preferred embodiment, characterized by the presence in the so-called "easy" circuit of adjustable pressure loss elements, the present invention has the additional advantage that it can change the quantity of water coming from the primary cooling between the two discharge circuits. Thus, the water flow destined to cool the coils of the inductor may be changed at will, and according to requirements, without at the same time changing the water flow of primary cooling, a flow which generally is a fixed given imposed by the technology of the ingot mold, the characteristics of the cast products and the conditions of the casting process.

Of course, the margin of operating this "shunt" with variable pressure losses is not unlimited and it is not possible to go all the way to the complete closure of the additional circuit. Its adjustment must take into account the necessary flow limits for the primary cooling and for the cooling of the inductor, and the range of adjustment depends primarily on the disposable pressure at the inlet, i.e. in the inlet chamber.

The invention will be well understood and other aspects and advantages will appear more clearly from the following description, given by way of example in no way limiting, with reference to the sheets of the accompanying drawings in which.

On the two figures, the identical elements are designates by the same reference numerals.

Figure 1:
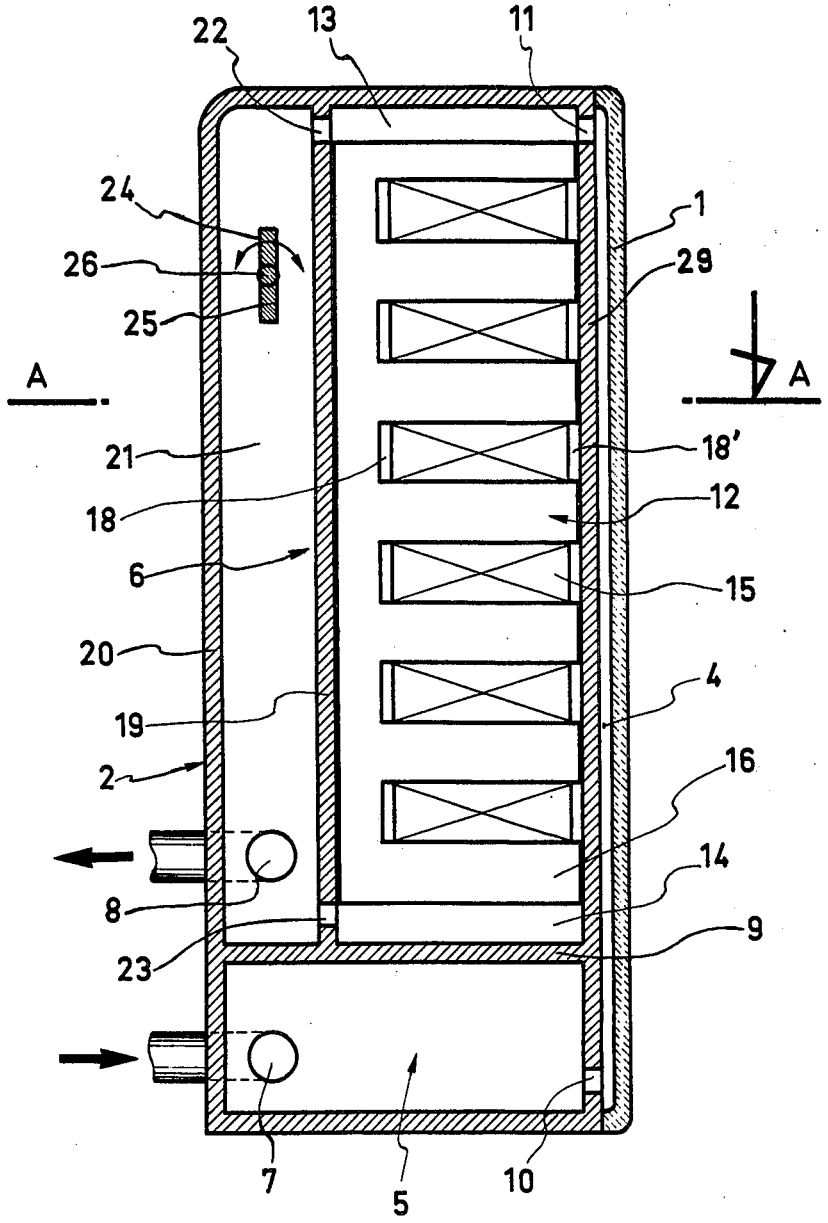
FIG. 1 represents a half view of an ingot mold for blooms in longitudinal section along a plane parallel to the direction of withdrawal of the products and along the line BB of the FIG. 2.

The ingot mold according to the invention is constituted by an interior tubular element 1 defining a passage for the cast products and a cooling box 2 fastened to the tubular element by bolts 3 (FIG. 1) traversing the casing 2 and screwed into threaded tap holes provided for this purpose in the tubular element. The latter presents on its outer (with respect to the cast products) face longitudinal channels 4 defining, with the casing 2, passages or "channels" for the circulation of the primary cooling water.

The cooling casing 2 is comprised of two superposed and contiguous chambers 5 and 6, constituting respectively the lower chamber 5 for the inlet of the cooling water, fed by inlet conduit 7, and the upper chamber 6 for the outlet of the cooling water through a discharge conduit 8. These two chambers are made tight with respect to each other by means of a partition wall 9. Each chamber has ports 10 and 11, respectively, placing them in communication with the longitudinal channels 4.

A polyphase electromagnetic inductor 12 is disposed in the outlet chamber 6 and extends substantially over the entire height thereof, leaving, however, free spaces 13 and 14 at their two ends, respectively. In the described embodiment, the electromagnetic inductor 12 constitutes a stator of a synchronous motor and generates a magnetic flux wave which is propagated in the cast products in the same direction as that of the withdrawal thereof. For this purpose, the inductor is composed of six conductors 15 disposed in pockets provided for this purpose in the magnetic support 16 and connected to a tri-phase electric current source in a suitable (and known) manner to obtain the above-described magnetic flux wave. As is known, this latter generates in the cast metal induced currents whose resultant magnetic fields interact, in turn, with the incident magnetic field to generate in the mass of the cast metal, and particularly adjacent the front of solidification, volume forces creating convection movements in the direction of the propagation of the incident magnetic flux wave.

In order to limit Foucault current losses in the magnetic support 16, this is made of sheets laminated perpendicularly to the axis of conductors 15, as is well known in the state of the art.

The conductors 15 are preferably copper bars whose number per pocket must be determined as a function of the maximum intensity the user desires to pass through the inductor. Nevertheless, these bars will preferably be disposed in their pocket in such a manner as to leave therebetween, and between the groups which they constitute, spaces permitting the passage of a cooling liquid which may be the primary cooling water itself.

These arrangements do not constitute a proper object of the invention and, here again, the state of the art is sufficiently rich in information to permit the person skilled in the art to make a judicious choice for the positioning of the conductive bars in the pockets.

Figure 2:
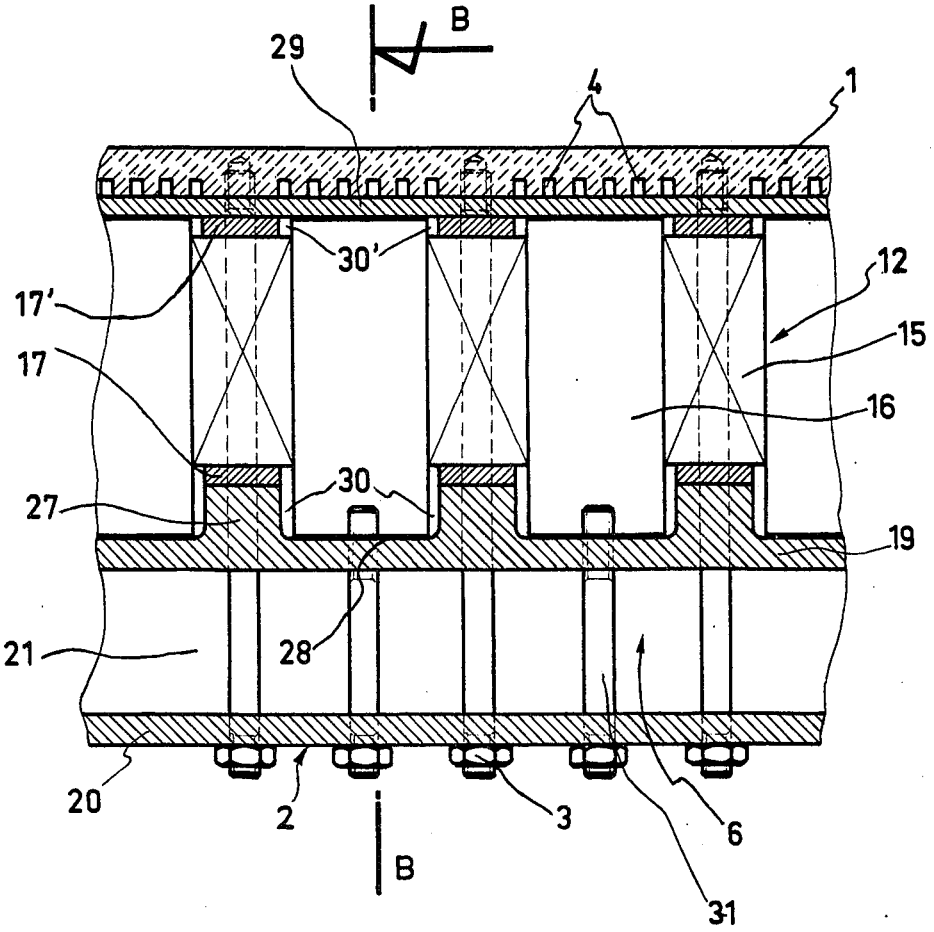
FIG. 2 represents a portion of the mold, seen in a traverse section along the plane AA of the FIG. 1.

By referring to the FIG. 2, it is seen that the magnetic support 16 is not made of a single piece but is constituted by several distinct blocks longitudinally separated from each other and letting be seen therebetween portions of conductors 15 in a manner further favoring their cooling.

According to the invention, a longitudinal partition wall 19 in the interior of the outlet chamber 6 is maintained fastened to the magnetic support 16. This partition wall has the function of defining with the outer casing 20 of the chamber 6 a lateral space 21 tight for the water circulating across the inductor and connected to the exterior by the discharge conduit 8 (FIG. 1).

The partition wall 19 has on its surface facing the inductor bosses 27 delimiting therebetween wide recesses 28 serving as base for the blocks of the magnetic support 16. Their respective positioning and the mechanical maintenance of the assembly are assured by means of bolts 3 and 31 screwed into the blocks and traversing the lateral space 21.

The conductors 15 are supported on the bosses 27 with the interposition of wedges 17 which extend over the entire height of the inductor.

Analogous wedges 17' are inserted between the conductors and the interior wall 29 of the cooling casing.

These wedges assure not only the maintenance of the conductors under the effect of vibrations resulting from the low frequency electric current used (about 3 to 15 Hz) but also the electrical insulation of these conductors with respect to the metallic partition wall 19 and the wall 29. The wedges 17 and 17' are, therefore, constituted by insulating material and present a good thermal resistance to the prevalent temperatures which rise at certain points to values of the order of 150°-200° C. A material such as epoxy glass will work perfectly.

As may be seen on FIG. 2, the recesses 28 are wider than the corresponding blocks of the support 16 so as to delimit between these blocks supplemental passages 30 and 30' communicating with spaces 18 and 18' (FIG. 1) respectively provided at the ends of the pockets in the blocks of the support 16 by means of bosses 27 extended by the wedges 17, on the one hand, and by the wedges 17', on the other hand.

By reference to FIG. 1, one sees that the longitudinal partition wall 19 has bores 22 and 23 at its upper end (22) and lower end (23), placing the lateral space 21 in respective communication with the spaces 13 and 14 situated above and below the inductor 12.

According to a preferred embodiment of the invention, the lateral space 21 has a variable pressure loss element 24 (FIG. 1) disposed at any point between the orifice of the discharge conduit 8 and the upper bores 22. In the described embodiment, and for reasons of technological simplicity, this element 24 is constituted by a rigid damper 25 pivotal about its axis of rotation 26 perpendicular to the plane of the figure. This rotation is effected through a maximum angle of 90° between a vertical position, called "open", as is shown in the figure, causing a small and little felt loss of pressure in the flow, and a horizontal position, called "closed", because the damper 25 completely blocks the lateral space 21 in this position.

The operation of the casting apparatus will now be described. A molten metal, for example steel, is introduced in a continuous manner into the passage defined by the interior tubular element 1 of the mold. The inductor 12 is switched on and water, at a pressure of about 8 bars, is introduced into the lower chamber 5 through inlet conduit 7. The water forcefully flows into the channels 4 through the ports 10. Considering the small section of these channels and the overall input, of the order of 180 $m^3/h$, imposed, the water circulates therethrough vertically upwardly at an elevated velocity, generally comprised between 8 and 12 m/sec. Accordingly, the calories extracted from the cast products are removed in a very efficient manner without the increase in the temperature of the water exceeding about 10°, due to this transfer of heat across the tubular element 1. As will be easily understood, this makes the primary cooling water still capable to cool the inductor 12 subsequently. At the upper end of channels 4, the water enters into the outlet chamber 6 through ports 11, where it occupies the space 13. The water is there divided into two distinct and parallel flow paths: the one cools the inductor by traversing it from end to end to reach the lower space 14 whence it is introduced into the lateral compartment 21 by the bores 23. This is a circuit which is "difficult" for the flow because the inductor itself constitutes an element of considerable pressure losses. The other flow path passes directly into the lateral space 21 by the upper bores 22 without encountering obstacles during its passage. This is, therefore, a direct discharge circuit with negligible pressure losses and qualifies, for this reason, as "easy" circuit, in contrast to the former one.

In these conditions, it is clear that only a small fraction of the quantity of water enters in the outlet chamber the "difficult" circuit for cooling the inductor. Tests made by the applicant have shown that for the proper cooling of the above-described electromagnetic inductor in a state of maximum operation, it was necessary to deliver thereto a quantity of water corresponding to about one tenth of that required for the primary cooling of the cast metal.

According to the present invention, if the flow in the "difficult" circuit does not attain a throughput sufficient to assure the thermal state of the inductor, the adjustable pressure loss element 24 present in the "easy" circuit is actuated in a manner to distribute a predetermined fraction of the flow to the cooling circuit of the inductor.

It is well understood that the invention is not limited to the described embodiment and numerous modifications or equivalents may be imagined without departing from the scope defined by the claims. Thus, the pressure loss element 24 has been described by applicant as a pivoting damper 25 in the described embodiment only because of its technological simplicity and its ease of operation. It is clear that means of different concept or structure may perfectly well be convenient as long as they serve the function of an adjustable blocking of the direct discharge circuit. For instance, it may be stated that a simple valve disposed in the discharge conduit 8 of the direct discharge conduit would produce the same result.

Similarly, the use of a mold having "channels" for the passage of the primary cooling water is not indispensible for the operation of the invention. The latter remains equally effective in the case of molds of other types, such as those with "cascades of water", generally known under the name of a mold with a "water jacket".

Also, the respective functions of the two superposed water chambers may obviously be reversed: a descending circulation of the primary cooling water in the channels 4 may also be used without substantially changing the advantages derived from the invention.

The present invention applies not only to the casting of products of large dimensions, such as blooms, but extends broadly to every metallic product, to the extent that the presence of an inductor, or of a similar device, in the cooling circuit risks the disturbance of the characteristics imposed upon the flow of the primary cooling liquid, characteristics which are well known in the state of this art and which relate especially to particular conditions of flow and velocity of the cooling liquid along the interior tubular element of the mold.

We claim:

1. In a mold for the continuous casting of molten metal, which comprises a tubular mold element having two open ends and defining a passage for the casting between the open ends, a cooling casing surrounding and fastened to the tubular mold element, the casing having an outer wall and an interior wall defining therebetween an enclosed cooling space, and the interior wall defining with the tubular mold element an inner space, a transverse partition wall between the outer and interior walls at one end of the cooling casing to separate the enclosed cooling space into two superposed chambers, an inlet conduit means connected to one of the chambers for supplying a cooling liquid to the one chamber, a discharge conduit means connected to the other chamber for removing the cooling liquid therefrom, the inner space being in communication with the one chamber at one end of the interior wall and with the other chamber at the other end of the interior wall whereby the cooling liquid flows from the one chamber through the inner space for cooling the tubular element and into the other chamber, and an electromagnetic inductor means arranged in the other chamber for moving the molten metal in the passage: the improvement of means dividing the other chamber into two separate liquid flow circuits, a first one of the circuits circulating the cooling liquid from the inner space through the entire electromagnetic inductor means to the discharge conduit means, and a second one of the circuits being arranged in parallel with the first circuit and directly removing the cooling liquid from the inner space to the discharge conduit means immediately after the cooling liquid has flowed through the inner space along the tubular mold element, the dividing means comprising an imperforate longitudinally extending partition wall dividing the other chamber into two laterally adjacent compartments fully separated from each other, an interior one of the compartments between the interior wall of the cooling casing and the longitudinally extending partition wall housing the electromagnetic inductor means and defining the first circuit, an exterior one of the compartments between the longitudinally extending partition wall and the outer wall of the cooling casing defining the second circuit and being in direct communication with the discharge conduit means, and port means at respective ends of the longitudinally extending partition wall for connecting the compartments and permitting circulation of the cooling liquid therethrough.

2. In the mold of claim 1, means for regulating the cooling liquid flow disposed in the exterior compartment between the discharge conduit means and one of the port means adjacent an end of the longitudinally extending partition wall where the cooling liquid flows into the interior compartment from the inner space.

* * * * *